US005660959A

United States Patent [19]

Moriyama et al.

[11] Patent Number: 5,660,959

[45] Date of Patent: Aug. 26, 1997

[54] TONER FOR COLOR ELECTROPHOTOGRAPHY AND FIXING METHOD USING THE SAME

[75] Inventors: Shinji Moriyama; Masayuki Maruta, both of Wakayama, Japan

[73] Assignee: KAO Corporation, Tokyo, Japan

[21] Appl. No.: 580,205

[22] Filed: Dec. 28, 1995

[30] Foreign Application Priority Data

Feb. 9, 1995 [JP] Japan ..... 7-046280

[51] Int. Cl.[6] ..... G03G 13/01; G03G 9/08

[52] U.S. Cl. ..... 430/45; 430/106; 430/111; 430/124

[58] Field of Search ..... 430/106, 111, 430/45, 124

[56] References Cited

U.S. PATENT DOCUMENTS 4,590,139 5/1986 Imai et al. ..... 430/106 X 5,262,264 11/1993 Shimizu et al. ..... 430/106

5,415,963 5/1995 Toya et al. ..... 430/106

FOREIGN PATENT DOCUMENTS 51-81623 7/1976 Japan .

52-30437 3/1977 Japan .

54-20344 7/1979 Japan .

58-27503 6/1983 Japan .

*Primary Examiner*—Roland Martin

[57] ABSTRACT

The toner for color electrophotography employing simultaneously fixing of various color toners, includes at least a coloring agent and a binder resin, wherein inorganic fine particles are internally added to the toner to have viscoelastic properties approximated to a level of other toners with different colors to be simultaneously fixed together therewith. The method for heat and pressure fixing a transferred image formed by toners of two or more colors on a recording medium using a heat roller, includes the step of fixing the transferred image formed by the above toner for color electrophotography together with black toner.

13 Claims, 1 Drawing Sheet

TONER FOR COLOR ELECTROPHOTOGRAPHY AND FIXING METHOD USING THE SAME

BACKGROUND OF THE INVENTION

1. Field of the Invention

The present invention relates to a toner for color electrophotography and a fixing method using the above toner. More specifically, the present invention relates to a toner for color electrophotography which is simultaneously fixed with different color toners and has viscoelastic properties approximated to a level of the other toners, and a fixing method using the above toner and a black toner.

2. Discussion of the Related Art

Toners may be classified into black toners used in normal monochromatic processes, and color toners used in full color processes and two-color printing processes. An example of monochromatic processes include Carlson method, comprising the steps of evenly charging a photoconductive insulating layer (a charging process); subsequently exposing the layer to eliminate the charge on the exposed portion, to thereby form an electrostatic latent image (an exposing process); visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process). In cases of two-color printing processes, two different color toners have to be used for repeating the above steps, and the toners have to be fixed simultaneously. Also, in full color processes, as in the case of the two-color printing processes, a number of color toners are subjected to similar steps and then allowed to be fixed simultaneously.

In the above fixing process, since the toners are demanded to have excellent fixing ability and offset resistance, a desired fixing ability is secured by controlling viscoelastic properties generally by selecting a kind of binder resins or adding various kinds of additives. For instance, in the case of black toner, carbon black is conventionally added to obtain a good reinforcing effect so that a given level of viscoelastic properties is obtained, to thereby secure the desired fixing properties in the resulting toner. Also, fixing apparatuses are designed to match the fixing properties owned by the toners.

However, in cases of color toners, since colors are greatly changed by the addition of carbon black, the carbon black cannot be similarly added to color toner as in the case of the black toner, thereby making it impossible to reinforce the color toners using carbon black. Also, coloring agents used for the color toners cannot exhibit good reinforcing effects as in the case of adding carbon black so that mechanical properties such as elastic modulus are somewhat lowered in the color toners by an extent that the carbon black can reinforce them. Thus, at present, since thermal properties of the binder resins usable for color toners and fixing mechanisms utilized therefor are quite limited, it has been known to be quite difficult to fix both kinds of the toners at the same time, while providing the fixing ability of the color toners approximated to a level of the fixing ability of the black toner.

On the other hand, it is well known that when the amount of carbon black to be blended in black toners is controlled so as to change the reinforcing effects, the changes in triboelectric charge, resistivity, and toning are undesirably likely to take place. Therefore, it is generally difficult to adjust the amount of carbon black in the black toner so as to approximate the values of viscoelastic properties of the color toners to those of the black toner.

Accordingly, in the field of art, a reinforcing agent for toners which does not change coloring and toning of the toners when used for color toners and is capable of controlling the viscoelastic properties of the toners is in strong demand.

Various proposals have been made to improve the toner properties by incorporating inorganic fine particles, such as silica fine particles, in the toner. For instance, Japanese Patent Laid-Open No. 54-20344 discloses a negatively chargeable powdery toner for electrophotography containing hydrophobic silica fine particles, wherein the amount of the hydrophobic silica fine particles is preferably 10 to 40% by weight. However, in this reference, the hydrophobic silica fine particles are added for the purpose of controlling the chargeability of the toners to negative polarity, not for the purpose of controlling the viscoelastic properties of the toners.

In addition, in other art disclosing the addition of silica fine particles in the toners, the addition is made for the purposes of controlling negative chargeability and of improving blocking resistance and fluidity (see Japanese Patent Laid-Open Nos. 51-81623, 52-30437, and 58-27503). Therefore, once again, the additions are not made for the purpose of controlling the viscoelastic properties of the toners.

SUMMARY OF THE INVENTION

An object of the present invention is to provide a toner for color electrophotography employing simultaneously fixing of various color toners, the toner having viscoelastic properties approximated to a level of other toners with different colors, thereby making it possible to simultaneously fix various color toners with a good performance.

Another object of the present invention is to provide a fixing method using the above toner for color electrophotography.

Specifically, the gist of the present invention is as follows:

(1) A toner for color electrophotography employing simultaneously fixing of various color toners, comprising at least a coloring agent and a binder resin, wherein inorganic fine particles are internally added to the toner to have viscoelastic properties approximated to a level of other toners with different colors to be simultaneously fixed together therewith;

(2) The toner for color electrophotography described in (1) above, wherein the other toners to be standards for viscoelastic properties are a black toner;

(3) The toner for color electrophotography described in (1) or (2) above, elastic modulus and viscosity coefficient of the toner for color electrophotography at a fixing temperature are approximated respectively within ±50% of elastic modulus and viscosity coefficient of the other toners to be simultaneously fixed together therewith;

(4) The toner for color electrophotography described in any one of (1) to (3) above, wherein an amount of the inorganic fine particles is from 1 to 10% by weight of the toner;

(5) The toner for color electrophotography described in any one of (1) to (4) above, wherein the inorganic fine particles are selected from the group consisting of silicon dioxide, titanium dioxide, alumina, and zirconium dioxide;

(6) The toner for color electrophotography described in any one of (1) to (5) above, wherein the inorganic fine particles have a specific surface area according to BET method of from 30 to 400 $m^2/g$;

(7) The toner for color electrophotography described in any one of (1) to (6) above, wherein the inorganic fine particles are subjected to a hydrophobic surface treatment;

(8) A method for heat and pressure fixing a transferred image formed by toners of two or more colors on a recording medium using a heat roller, comprising the step of fixing a transferred image formed by the toner for color electrophotography described in any one of (1) to (7) together with a black toner; and (9) The method described in (8) above, wherein the toner for color electrophotography is defined as in any one of (3) to (7) above.

BRIEF DESCRIPTION OF THE DRAWING

The present invention will become more fully understood from the detailed description given hereinbelow and the accompanying drawing which is given by way of illustration only, and thus, is not limitative of the present invention, and wherein.

Figure 1:
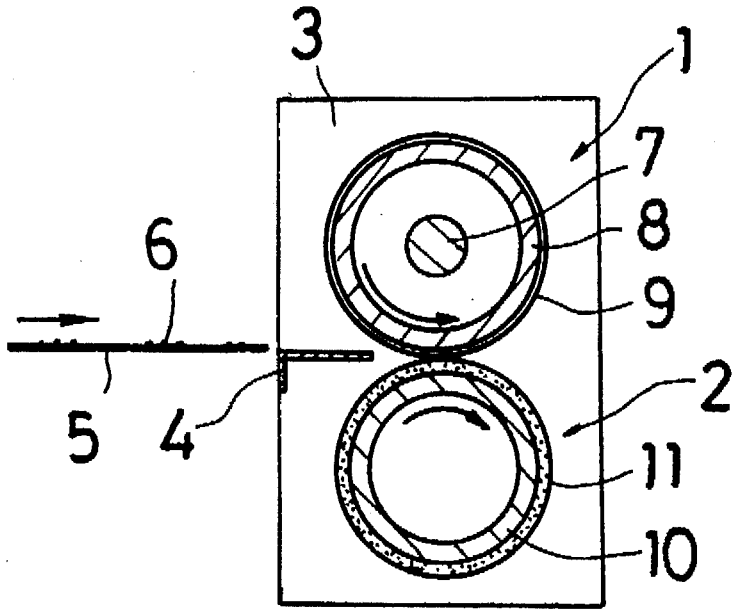
FIG. 1 is a partial schematic transverse sectional view showing one example of an apparatus used for the fixing method of the present invention.

Each of the reference numerals in FIG. 1 is as follows:

1 denotes a heat roller, 2 a pressure roller, 3 a side plate, 4 a feeding guide, 5 a recording medium, 6 a transferred image, 7 a heat source, 8 a hollow core, 9 a releasing layer, 10 a hollow core, and 11 an elastic layer.

DETAILED DESCRIPTION OF THE INVENTION

The toner for color electrophotography of the present invention employing simultaneously fixing of various color toners, comprising at least a coloring agent and a binder resin, is characterized in that inorganic fine particles are internally added to the toner to have viscoelastic properties approximated to a level of other toners with different colors to be simultaneously fixed together therewith.

As for the usable inorganic fine particles, any white or transparent inorganic fine particles which give reinforcing effects, such as improvements in the viscoelastic properties, without affecting the toning of the color toners when internally added to the toner are suitably used.

Specifically, examples of the usable inorganic fine particles include silicon dioxide, kaolin clay, agalmatolite clay, talc, sericite, baked clay, mica, bentonite, asbestos, calcium silicates, pumice powder, magnesium carbonate and barium sulfate. In addition, in order to improve dispersibility, the surface of the inorganic fine particles may be subjected to a hydrophobic surface treatment, depending upon the types of the binder resins used. The inorganic fine particles in the present invention are preferably those which are widely used and relatively inexpensive, selected from the group consisting of silicon dioxide, titanium dioxide, alumina, and zirconium dioxide, with a particular preference given to a hydrophobic silica.

The above inorganic fine particles have a specific surface area according to BET method of normally from 30 to 400 $m^2/g$, preferably from 100 to 300 $m^2/g$. Within the above-specified range, the particle size factors for the reinforcing and filling effects are likely to be well performed, and the dispersion of the inorganic fine particles are made easy.

The amount of the inorganic fine particles added is an amount sufficient for giving the toner the viscoelastic properties approximated to a level with the other toners which are simultaneously fixable therewith. Specifically, the amount of the inorganic fine particles in the toner is normally from 1 to 10% by weight, and particularly they may be included in an amount of 2 to 7% by weight from the viewpoint of improving the viscoelastic properties. When the amount exceeds 10% by weight, the drastic changes in the triboelectric properties are likely to take place, thereby causing deficiency in the triboelectric charges. Also, toning of the resulting toner is affected, thereby changing color of the resulting formed images.

In the present invention, as for the other toners to be standards for viscoelastic properties, those which are conventionally used in simultaneous fixing of various color toners are used. Normally, the black toner having generally high viscoelastic properties due to the addition of carbon black is usually used.

In the present invention, since the viscoelastic properties of the toner can be improved by adding the above inorganic fine particles to the toner, the viscoelastic properties of the toner can be approximated to a level of the black toner which are simultaneously fixed together therewith by suitably controlling the kinds and the amounts of the inorganic fine particles used.

Here, "the viscoelastic properties of the toner are approximated to a level of other toners" means that the elastic modulus and the viscosity coefficient of the toner of the present invention at a given fixing temperature is within the range of ±50%, preferably within ±30%, of those of the other toners to be simultaneously fixed together therewith.

In the present invention, the above elastic modulus and viscosity coefficient are evaluated by measuring the temperature dependencies of the above properties using "DYNAMIC ANALYZER RDA II" (manufactured by Rheometrics Inc.) by placing a between two parallel discs, and applying a given stress to the molten toner at an appropriate angular frequency via the discs, and more specifically, they may be measured under the conditions given in Examples as set forth below.

As a result of approximating the viscoelastic properties of the toner of the present invention to those of other toners as mentioned above, two or more color toners can be suitably fixed at the same time without causing offset phenomenon.

In the present invention, since the viscoelastic properties of the toners can be easily controlled by the addition of the inorganic fine particles as explained above, the binder resins can be selected from a wide variety of resins. In other words, the binder resins used in the present invention include various kinds of resins usable for black toners in addition to the resins usable for conventional color toners. Specifically, examples thereof include homopolymers or copolymers of the following monomers: Styrene and styrene derivatives, such as styrene, chlorostyrene, and α-methylstyrene; monoolefins such as ethylene, propylene, butylene, and isobutylene; vinyl esters, such as vinyl acetate, vinyl propionate, vinyl benzoate, and vinyl butyrate; esters of α-methylenic, aliphatic monocarboxylic acids, such as methyl acrylate, acrylate, butyl acrylate, octyl acrylate, dodecyl acrylate, phenyl acrylate, methyl methacrylate, ethyl methacrylate, butyl methacrylate, and dodecyl methacrylate; vinyl ethers, such as vinyl methyl ether, vinyl ethyl ether, and vinyl butyl ether; and vinyl ketones, such as vinyl methyl ketone, vinyl hexyl ketone, and vinyl isopropenyl ketone. Also, natural and synthetic waxes, polyesters, polyamides, epoxy resins, polycarbonates, polyurethanes, silicone resins, fluorine resins, and petroleum resins may be used. The methods for producing the above resins are not particularly limited, and any of ordinary known methods may be employed.

The toner of the present invention contains the inorganic fine particles and the binder resins mentioned above, and a coloring agent as an essential component together with a charge control agent, and if necessary, an offset inhibitor and fluidity improver may be added thereto.

The coloring agents used for color toners usable in the present invention are not particularly limited, and the following, for instance, may be used:

Phthalocyanines; monoazo pigments, such as C. I. Pigment Red 5, C. I. Pigment Orange 36, C. I. Pigment Red 22; disazo pigments, such as C. I. Pigment Yellow 83; anthraquinone pigments, such as C. I. Pigment Blue 60; disazo dyes, such as Solvent Red 19; and rhodamine dyes, such as Solvent Red 49.

The usable positive charge control agents may be any of low-molecular compounds to polymeric compounds including polymers, without particular limitation. Examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.); triphenylmethane dyes; quaternary ammonium salt compounds; and vinyl polymers having an amino group.

Examples of the negative charge control agents include metal complexes of monoazo dyes; nitrohumic acid and salts thereof; substances having one or more nitro groups or halogen elements; sulfonated copper phthalocyanines; and maleic acid anhydride copolymers.

In addition, known property improvers contained in the toner of the present invention are offset inhibitors, fluidizing agents, thermal property improvers, such as metal complexes, such as chromium complexes of 3,5-di-tert-butylsalicylic acid, and metal oxides, such as zinc oxide, may be suitably used in an amount so as not to impair the effects the present invention.

The toners of the present invention may be produced by any of conventionally known production methods, such as kneading and pulverizing method, spray-drying method, and polymerization method. For instance, a general example for production include a method comprising the steps of uniformly dispersing and blending the resins, coloring agents, charge control agents, etc. in a known mixer, such as a ball-mill, melt-kneading the obtained mixture in a sealed kneader or single-screw extruder or double-screw extruder, cooling the kneaded mixture, pulverizing and classifying the obtained mixture. Also, fluidizing agents may be added to the toner, where necessary.

As a result, colored powders having an average particle size of from 5 to 15 μm, namely the toner for color electrophotography of the present invention, are obtained, which may be used by itself as a one-component developer. Alternatively, in the case of preparing a two-component developer composition, the above toner is blended with magnetic powders in a suitable amount, such as irregularly shaped carriers, coated ferrite carriers, or spherical coat carriers, to give a developer composition.

The method of the present invention for heat and pressure fixing a transferred image formed by toners of two or more colors on a recording medium using a heat roller is characterized by the step of fixing a transferred image formed by the toner for color electrophotography explained above together with a black toner. Therefore, as long as the method is capable of fixing a transferred formed on a recording medium with two or more color toners by means of heat and pressure using a heat roller, any of known methods may be employed. The fixing method of the present invention will be explained in detail below referring to the FIGURE showing a typical fixing apparatus.

FIG. 1 is a partial schematic transverse sectional view showing one example of an apparatus used for the fixing method of the present invention.

In FIG. 1, 1 denotes a heat roller, and 2 denotes a pressure roller, both of which are supported by and inserted between a pair of side plates 3, 3 via shaft bearings (not illustrated in the FIGURE). 4 denotes a feeding guide, and 5 denotes a recording medium which bears a transferred image 6 and is transported in a direction shown by an arrow in the FIGURE. Next, the heat roller 1 comprises a metallic, hollow core 8, and a heat source 7 in an inner portion thereof, the hollow core 8 being coated by a releasing layer 9 having good heat resistance. On the other hand, the pressure roller 2 comprises a metallic, hollow core 10, the peripheral surface thereof being coated with an elastic layer 11 having good heat resistance. Incidentally, the heat roller 1 and the pressure roller 2 are pressed against each other by a pressing mechanism (not illustrated in the FIGURE) to be in a pressing state, the pressed portion of both rollers forming a so-called "nip portion" having a given contact width.

Having the above construction, the transferred image 6 can be fixed on the surface of the recording medium 5 by the following steps. Electricity is supplied to the heat source 7 to give sufficient thermal energy for fixing the toner to a surface of the heat roller 1, and the heat roller 1 and the pressure roller 2 are rotated together in a pressing state in a direction shown by an arrow drawn in each of the rollers. The recording medium 5 bearing a transferred image 6 on its surface is conveyed along the feed guide 4 in a direction shown by an arrow, and the recording medium 5 is passed through the heat roller 1 and the pressure roller 2.

The black toners which can be used together with the toners for color electrophotography of the present invention are not particularly limited, and any of black toners conventionally used in monochromatic processes are applicable.

By using the above heat-and-fixing method explained above, the electric consumption can be made remarkably smaller than other heat-and-fixing methods using such devices as oven or flash lamps. In addition, a high-speed fixing can be achieved, thereby making it highly advantageous. Further, by using a heating member for an elastic layer of the roller, the overall apparatus can be miniaturized.

Since the toner for color electrophotography of the present invention has viscoelastic properties approximated to the level of other toners such as the black toner, all the toners used have wide non-offset region, thereby making it possible to carry out simultaneous fixing of various kinds of toners in good performance. Therefore, the method of the present invention can be well performed by fixing various kinds of toners simultaneously without changing their toning due to the properties of the above toner.

EXAMPLES

The present invention is hereinafter described in more detail by means of the following resin production examples, examples, comparative examples, and test examples, without intending to limit the scope of the present invention thereto.

Resin Production Example 1 (Polyester A Type)

Seven-hundred grams of polyoxypropylene(2.2)-2,2-bis (4-hydroxyphenyl)propane, 130 g of fumaric acid, 53.4 g of n-dodecenyl succinic anhydride, and 0.1 g of hydroquinone were placed in a one-liter four-neck glass flask equipped with a thermometer, a stainless stirring rod, a reflux condenser, and a nitrogen inlet tube. The contents were heated in a mantle heater to a temperature of 230° C., to thereby allow the components to react with each other under a nitrogen stream while stirring. The acid value was measured at a point no water formed by hydrolysis flowed, and it was found to be 1.5 KOH mg/g.

Further, 63.4 g of trimellitic anhydride was added to the above mixture, and the components were allowed to react with for about 8 hours. The reaction was terminated when the acid value reached 20 KOH mg/g. The obtained resin was a pale yellow solid, whose softening point determined by ring-ball method was 120° C.

Example 1

| Color Toner A | |
|---|---|
| Polyester A Type | 100 parts by weight |
| Blue Pigment ("CYANINE BLUE KRS," manufactured by Sanyo Color Works, LTD.) | 5 parts by weight |
| Polypropylene Wax ("VISCOL 660P," manufactured by Sanyo Chemical Industries Ltd.) | 2.5 parts by weight |
| Charge Control Agent ("COPY CHARGE NEG," manufactured by Hoechst) | 1.5 parts by weight |
| Inorganic Fine Particles ("AEROZIL R-972," manufactured by Nippon Aerozil Ltd.) | 5 parts by weight |

The above components were blended and melt-kneaded, and the kneaded mixture was pulverized and classified, to give a toner having an average particle size of 11 μm. Here, melt-kneading was carried out by an extruder, pulverization was carried out by a jet mill, and classification was carried out by an air-stream type classifier.

Reference Example 1

| Black Toner B | |
|---|---|
| Polyester A Type | 100 parts by weight |
| Carbon Black ("M-880," manufactured by Cabot Corporation) | 9 parts by weight |
| Polypropylene Wax ("VISCOL 660P," manufactured by Sanyo Chemical Industries Ltd.) | 2.5 parts by weight |
| Charge Control Agent ("BONTRON S-34," manufactured by Orient Chemical Co., Ltd.) | 1.5 parts by weight |

The above components were blended and melt-kneaded, and the kneaded mixture was pulverized and classified in the same manner as in Example 1, to give a toner having an average particle size of 11 μm.

Comparative Example 1

| Color Toner C | |
|---|---|
| Polyester A Type | 100 parts by weight |
| Blue Pigment ("CYANINE BLUE KRS," manufactured by Sanyo Color Works, LTD.) | 5 parts by weight |
| Polypropylene Wax ("VISCOL 660P," manufactured by Sanyo Chemical Industries Ltd.) | 2.5 parts by weight |
| Charge Control Agent ("COPY CHARGE NEG," manufactured by Hoechst) | 1.5 parts by weight |

The above components were blended and melt-kneaded, and the kneaded mixture was pulverized and classified in the same manner as in Example 1, to give a toner having an average particle size of 11 μm.

Test Example 1

The three kinds of toner obtained above were evaluated with respect to their thermal properties, such as viscoelastic properties and softening temperature as detailed below.

(1) Viscoelastic Properties

The viscoelastic properties were determined by using "DYNAMIC ANALYZER RDA II" (manufactured by Rheometrics Inc.) equipped with parallel discs. Specifically, a toner was placed between two parallel plates, and a given stress was applied to the molten toner via the discs under the following conditions, to thereby evaluate the temperature dependencies of the elastic modulus and the viscosity index.

Parallel plates: radius: 12.5 mm

Test mode: Kinematic viscoelastic property analysis

Sweep Type: Frequency/Temperature-Sweep

Strain: 2%

Measured Temperature: 220° C.→60° C.

Frequency: 0.628 rad/s→291.48 rad/s

Step size: 10° C.

Soak time: 30 seconds

Point/decade: 3

Auto-tension (2) Softening Temperature

The softening temperature refers to the temperature corresponding to one-half of the height (h) of the S-shaped curve showing the relationship between the downward movement of a plunger (flow length) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 30 $kg/cm^2$ thereto with the plunger.

The results are shown together in Table 1.

TABLE 1

| | | Color Toner A | Black Toner B | Color Toner C |
|---|---|---|---|---|
| Elastic Modulus ($dyn/cm^2$) | at 150° C. | $1.0 \times 10^5$ | $1.5 \times 10^5$ | $4.0 \times 10^4$ |
| | at 190° C. | $4.9 \times 10^4$ | $5.6 \times 10^4$ | $9.0 \times 10^3$ |

TABLE 1-continued

| | | Color Toner A | Black Toner B | Color Toner C |
|---|---|---|---|---|
| Viscosity Coefficient (dyn/cm$^2$) | at 150° C. | $2.0 \times 10^4$ | $4.0 \times 10^4$ | $1.2 \times 10^4$ |
| | at 190° C. | $8.0 \times 10^3$ | $1.0 \times 10^4$ | $4.0 \times 10^3$ |
| Softening Temperature (°C.) | | 128.4 | 127.0 | 123.0 |

As is clear from Table 1, Color Toner A, where the hydrophobic silica was internally added, had remarkably higher elastic modulus and viscosity coefficient when compared with Color Toner C where no hydrophobic silica was internally added. In addition, Color Toner A had substantially the same level of viscoelastic properties as Black Toner B.

Incidentally, Color Toner A where inorganic fine particles (hydrophobic silica) were internally added had substantially no differences in toning with Color Toner C where no inorganic fine particles were added.

Test Example 2

The offset resistance test was conducted using three kinds of the toners obtained above as detailed below. First, a commercially available laser beam printer ("LB-040A," manufactured by Hitachi Koki Co., Ltd.) was modified so as to enable two-color printing at the same time. The black toner was prepared by using a coat magnetite carrier having an average particle size of 120 μm to have a toner concentration of 2.5% by weight. The color toner was prepared by using a coated ferrite carrier having an average particle size of 80 μm to have a toner concentration of 4.5% by weight. Each of the toners was loaded in a developer vessel. The combinations of toners were as follows: Black Toner B and Color Toner A, or Black Toner B an Color Toner C. For each of the combinations, the toners with different colors are placed on the surface of a photoconductor, after which the toners are simultaneously transferred and then simultaneously fixed. The offset resistance was evaluated by carrying out a test by varying the fixing temperatures from 140° C. to 220° C. In addition, the image quality of the resulting fixed images was compared at a fixing temperature of 180° C. The results of the offset resistance are shown in Table 2, and the results of the image quality comparison are shown in Table 3.

TABLE 2

| | Color Toner A | Black Toner B | Color Toner C |
|---|---|---|---|
| Non-Offset Region | 155–200° C. | 160–200° C. | 155–170° C. |

TABLE 3

| | Combination of Toners A and B | Combination of Toners B and C |
|---|---|---|
| | Color Toner A: | Black Toner B: |
| Image Quality | Excellent | Excellent |
| Offset Resistance | No Problems | No Problems |

TABLE 3-continued

| | Combination of Toners A and B | Combination of Toners B and C |
|---|---|---|
| | Black Toner B: | Color Toner C: |
| Image Quality | Excellent | Excellent |
| Offset Resistance | No Problems | Hot Offsetting Generated |

As is shown in Table 2, Color Toner A, where the hydrophobic silica was internally added, had a wider non-offset region at the high temperature side, when compared with Color Toner C where no hydrophobic silica was internally added. In addition, Color Toner A, where the hydrophobic silica was internally added, had substantially the same offset resistance as Black Toner B.

As is shown in Table 3, the internal addition of the hydrophobic silica makes it possible to fix two kinds of toners conventionally having different thermal properties simultaneously. In addition, the image quality is not badly affected by the internal addition of the hydrophobic silica, thereby making it possible to obtain extremely good image quality.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A combination of toners for color electrophotography employing simultaneously fixing of various color toners comprising a toner to be a standard for viscoelastic properties, each toner comprising at least a coloring agent and a binder resin, wherein inorganic fine particles are internally added to toners other than the standard toner in an amount sufficient to import viscoelastic properties approximated to a level of the standard toner.

2. The combination of toners for color electrophotography according to claim 1, wherein said standard toner is a black toner.

3. The combination of toners for color electrophotography according to claim 1, wherein elastic modulus and viscosity coefficient of the toner for color electrophotography at a fixing temperature are approximated respectively within ±50% of elastic modulus and viscosity coefficient of the standard toner.

4. The combination of toners for color electrophotography according to claim 1, wherein an amount of the inorganic fine particles is from 1 to 10% by weight of the toner.

5. The combination of toners for color electrophotography according to claim 1, wherein said inorganic fine particles are selected from the group consisting of silicon dioxide, titanium dioxide, alumina, and zirconium dioxide.

6. The combination of toners for color electrophotography according to claim 1, wherein said inorganic fine particles have a specific surface area according to BET method of from 30 to 400 m$^2$/g.

7. The combination of toners for color electrophotography according to claim 1, wherein said inorganic fine particles are subjected to a hydrophobic surface treatment.

8. A method for heat and pressure fixing a transferred image formed by toners of two or more colors on a recording medium using a heat roller, comprising the step of fixing the transferred image formed by the toner for color electrophotography according to claim 1 together with a black toner.

9. The method according to claim 8, wherein the toner for color electrophotography is defined as in claim 3.

10. The method according to claim 8, wherein the toner for color electrophotography is defined as in claim 4.

11. The method according to claim 8, wherein the toner for color electrophotography is defined as in claim 5.

12. The method according to claim 8, wherein the toner for color electrophotography is defined as in claim 6.

13. The method according to claim 8, wherein the toner for color electrophotography is defined as in claim 7.

* * * * *